United States Patent [19]

Harris

[11] Patent Number: 4,907,726

[45] Date of Patent: Mar. 13, 1990

[54] STRIPPING DISPENSER PACKAGE FOR VISCOUS PRODUCTS

[75] Inventor: Kurt N. Harris, Haskins, Ohio

[73] Assignee: Owens-Illinois Closure Inc., Toledo, Ohio

[21] Appl. No.: 263,467

[22] Filed: Oct. 27, 1988

[51] Int. Cl.[4] ..... B67D 5/60

[52] U.S. Cl. ..... 222/145; 222/129; 222/94

[58] Field of Search ..... 222/94, 129, 145

[56] References Cited

U.S. PATENT DOCUMENTS

| | | | |
|---|---|---|---|
| 2,147,686 | 2/1939 | Pagby | 222/129 |
| 2,873,887 | 2/1959 | Spero | 222/94 |
| 2,959,327 | 11/1960 | Bloom | 222/94 |
| 4,437,584 | 3/1984 | Connors et al. | 222/137 |
| 4,437,591 | 3/1984 | von Schuckmann | 222/391 |
| 4,438,871 | 3/1984 | Eckert | 222/137 |
| 4,461,403 | 7/1984 | Prahs | 222/129 |
| 4,691,847 | 9/1987 | Ford et al. | 222/259 |
| 4,826,044 | 5/1989 | Volfson | 222/145 |

FOREIGN PATENT DOCUMENTS

| | | | |
|---|---|---|---|
| 622969 | 6/1961 | Canada | 222/94 |
| 645813 | 7/1962 | Canada | 222/94 |
| 654838 | 12/1962 | Canada | 222/94 |

*Primary Examiner*—Joseph J. Rolla

*Assistant Examiner*—Steve Rim

[57] ABSTRACT

A hand operable dispensing package for dispensing first and second viscous products in a composite product having a bead of the first viscous product and a plurality of spaced apart longitudinally extending stripes of the second viscous product on the outside of the bead of the first viscous product. The dispensing package has an elongate dispensing spout and an annular insert positioned in the dispensing spout with an outer surface of an inner portion of the annular insert and an inner surface of an inner portion of the dispensing spout defining an annular recess. The second viscous product is packaged in the annular recess and the first viscous product is packaged in a portion of the dispensing package below the annular recess and at least to the level of a free end of the annular insert. The annular insert has a multiplicity of transversely extending passages extending therethrough to permit the second viscous product to flow from the annular recess into the annular insert where it lodges in longitudinal recesses in the first viscous product flowing through the annular insert from the free end which are formed by internal ribs in the inner end of the annular insert. The dispensing package is provided with a pumping mechanism to simultaneously pressurize the first viscous product and the second viscous product.

19 Claims, 4 Drawing Sheets

STRIPPING DISPENSER PACKAGE FOR VISCOUS PRODUCTS

BACKGROUND OF THE INVENTION

1. Field of the Invention

This invention relates to a hand-operable dispensing package for a viscous product such as a gel, a cream, or a paste such as toothpaste. More particularly, this invention relates to a dispensing package which simultaneously dispenses first and second viscous products in a single bead that is made up of a core of the first product with spaced apart strips or stripes of the second product on the outside of the first product.

2. Description of the Prior Art

U.S. Pat. No. 4,437,591 (A. von Schuckmann) discloses a prior art hand-operable dispensing package for a viscous product in which the product is contained within a cylindrical portion of the package and is dispensed in the form of a bead through a dispensing opening at an end of the package under the influence of a hand-operable pumping element at the dispensing end of the package, in combination with a unidirectionally movable piston which is mechanically linked to the pumping element so that it advances step by step toward the dispensing end of the package to effect the dispensing of product therefrom. However, a dispenser according to this reference dispenses a bead of uniform color and composition from but a single viscous product supply.

The concept of laying strips or stripes of a second viscous product onto a core of a first viscous product being dispensed from a viscous product dispensing package is disclosed in U.S. Pat. No. 4,461,403 (H. Prahs), and dispensers of this type have gained popularity in the dispensing of toothpaste in multiple colors. However, the dispenser of this reference applies the second product to the first product only over a portion of the periphery thereof. U.S. Pat. No. 4,437,584 (Connors et al.), in reference to the embodiment illustrated in FIG. 5 of the drawing thereof, also discloses a striping dispenser, and while the dispenser of this reference appears to apply a second viscous product to the exterior of a first viscous product in a circumferentially uniform pattern, the second product is brought into communication with the first product through slots at locations substantially inwardly of the dispensing outlet of the container, and the slots are subject to being gradually covered by the first product as striped product is dispensed from the container, which would detract from the effectiveness of striping during the final stages of the dispensing of the product.

SUMMARY OF THE INVENTION

According to the present invention there is provided a dispensing package for simultaneously dispensing first and second viscous products with the second viscous product being applied in spaced apart strips or stripes on a core of a first viscous product. The first and second viscous products are packaged in the body of the dispenser in axially aligned masses with the second viscous product being positioned closer to the dispensing end of the dispenser than the first viscous product. An annular insert is positioned in a dispensing spout of the container and extends downwardly therefrom into the interior of the container at least to the initial level of the first viscous product. The annular insert has an outer end which fits snugly within an elongate dispensing spout of the dispensing package, and an inner end which is smaller in its external dimensions than the outer end and which defines an annular recess with the inside of the adjacent portion of the dispensing spout. A circumferential series of spaced apart passages extend through the inner end of the annular insert, near the juncture of the inner end and the outer end, and the interior of the inner end of the annular insert is provided with spaced apart, longitudinally extending ribs in alignment with the passages through the annular insert. The interior of the annular insert is in communication with the first viscous product and the annular recess between the inner end of the annular insert and the dispensing spout is in communication with the second viscous product. Thus, when pumping pressure is applied to the viscous products, for example, by a unidirectionally movable pumping piston within the dispensing package, the first and second viscous products, which are in contact with one another, are simultaneously pressurized and, therefore, simultaneously dispensed through the dispensing spout with the second viscous product passing through the spaced apart passages of the annular insert to form strips or stripes on the outside of the first viscous product, preferably in longitudinal indentations or recesses in the first viscous product formed by the longitudinally extending ribs in the inner portion of the annular insert.

Accordingly, it is an object of the present invention to provide an improved dispensing package for the simultaneous dispensing of first and second viscous products. More particularly, it is an object of the present invention to provide a simple, reliable and relatively inexpensive hand-operable dispensing package for the simultaneous dispensing of first and second viscous products with one of such viscous products forming strips or stripes on the exterior of the other of the viscous products.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
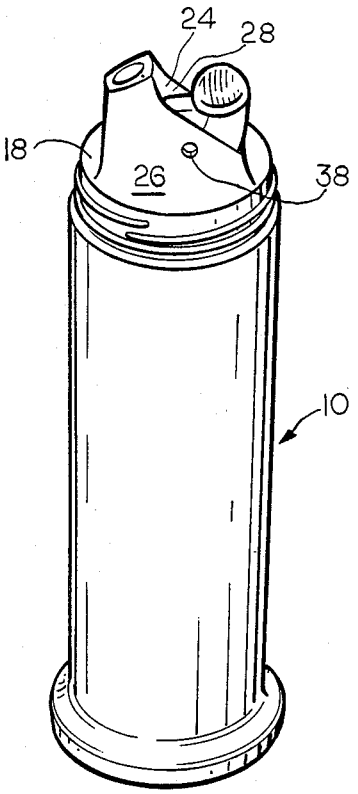
FIG. 1 is a perspective view of a striping dispenser package for viscous products according to the preferred embodiment of the present invention.

As is shown in the various drawing figures, according to the present invention there is provided a dispensing package which is generally identified by reference numeral 10. The dispensing package 10 is suitable for the packaging and dispensing of a first viscous product P1 from a mass of such product, for example, a gel, a cream, or a paste such as toothpaste, and is made of a generally cylindrical container 12 which has a dispensing end 12*a* that is at the top of the dispensing package 10 in the illustrated upright orientation of the dispensing package 10. Further, the generally cylindrical container 12 also has a bottom end 12*b*. The dispensing package 10 may be provided with an inverted, cup-shaped closure, not shown, which may be threadably secured to an externally threaded portion 12*c* at the dispening end 12*a* of the container 12 to permit closing of the dispensing package 10 until it is ready for first use and thereafter during periods of time when it is not in use.

The generally cylindrical container 12 is made up of a generally cylindrical body portion 14 which, preferably, is circular in cross-section. The body portion 14 of the container 12 is preferably formed from a generally rigid thermoplastic material, preferably a material whose principal ingredient is polypropylene or high density polyethylene, by injection molding, so long as any such material is compatible with the products to be packaged in contact therewith. The container 12 also includes a one-way movable piston 16 which is initially positioned within the body portion 14 near the bottom end 12*b* of the container 12, and the movable piston 16 is also preferably formed from a generally rigid thermoplastic material, such as polypropylene or high density polyethylene.

The dispensing end 12*a* of the container 12 is provided with a transversely extending end structure 18 having a dispensing spout 20 which is in fluid communication with the product P1 within the container 12. The end structure 18 of the dispensing end 12*a* of the dispensing container 12 further has an outwardly facing recess 24 which is defined by spaced apart side walls 26 and 28, a bottom wall 30, the dispensing spout 20, and an end wall 32 which is spaced from the dispensing spout 20. The recess 24 receives a major portion 34 of a complex dispensing pump 36, the dispensing pump 36 being pivotally attached to the sidewalls 26 and 28, for example, by axially aligned projections (not shown) which are received in apertures 38 and 40 of the sidewalls 26 and 28, respectively, for oscillation of the dispensing pump 36 about an axis through the apertures 38 and 40 which is identified by the letter A in FIG. 3.

The dispensing pump 36 is arranged as a first class lever with respect to the axis "A", with a downwardly depressable, finger engaging contact button 42 on the one side of the axis A and a lifter portion 44 on the other side of the axis A. The dispensing pump 36 further has a rod portion 46 which is slidingly reciprocable along a vertically extending axis in an aperture 48 in the bottom wall 30 of the end structure 18 of the body portion 14, and which is connected to the lifter portion 44 by a flexible connector portion 50 of the dispensing pump 36. Thus, by depressing the button 42 of the dispensing pump 36 in the direction of an arrow AR in FIG. 4, the rod portion 46 of the dispensing pump 36 will be lifted along its vertically extending axis within the aperture 48 in the end structure 18. The dispensing pump 36 further has a resilient tail portion 52 which is positioned on the same side of the axis A as the button 42 and which is trapped within the outwardly facing recess 24 of the end structure 18. The tail portion 52 of the dispensing pump 36 serves as a spring to bias the dispensing pump 26 toward the position indicated in FIG. 4 so as to return the dispensing pump 36 to such position on the removal of the dispensing load applied in the direction of the arrow AR. Motion of the dispensing pump 26 past the FIG. 4 position is blocked by a downwardly facing shoulder 54 on the other side of the lifter portion 44 which engages an upwardly facing shoulder 56 on the dispensing spout 20.

The dispensing pump 36 is further provided with a rodlike member 58 which is attached to the rod portion 46 and which extends downwardly therefrom through the interior of the body portion 14 of the container 12. A lower portion of the rod member 58 passes through an opening 16*a* in the piston 16 for one-way sliding engagement between the rodlike member 58 and the piston 16. A metallic clip 60 is attached to the bottom of the piston 16, and the metallic clip 60 is attached with inwardly and downwardly projecting spaced apart tines 60*a* each of which engages the rodlike member 58 to ensure that the motion of the rodlike member 58 will only be downwardly through the opening 16*a* of the piston 16. Thus, each time that the rodlike member 58 is moved downwardly, it will deflect the tines 60*a* of the metallic clip 60 to move downwardly through the opening 16*a* in the piston 16, and upon the retraction of the rodlike member 58 it will non-slidably engage the tines 60*a* to draw the piston 16 upwardly within the container 12 by a distance which is equal to a pumping stroke of the rodlike member 58. Upon the depressing of the button 42 of the dispensing pump 36 and the resulting lifting of the rodlike member 58 nd the piston 16 within the container 12, the piston 16 will pressurize the product P1 within the container 12, thus forcing product P1 through the opening 22 in the dispensing spout 20 of the container 12 in the irregular configuration of the opening 22, shown as a bead B in FIG. 10, and upon the release of the pumping pressure on the button 42, the tail portion 52 of the dispensing pump 36 will return the major portion 34 to its original, FIG. 4 position, thereby depressing the rodlike member 58 through the piston 16 to await the next pumping cycle of the dispensing pump 36.

Striping in the dispensing package 10 of the present invention is accomplished by providing an annular insert 62 having an outer portion 62*a* which completely and snugly fills an outer, terminal portion 20*a* of the spout 20, an inner portion 62*b* which is smaller in its external configuration than the outer portion 62*a* to thereby form an annular recess 64 between the inner portion 62*a* of the annular insert 62 and an adjacent inner portion 20*b* of the discharge spout 20, and a circumferential series of evenly spaced apart transversely extending passages 62*c* in the inner portion 62*b* of the annular insert 62, adjacent its juncture with the outer portion 62*a*. For example, when the dispensing package 10 is to be used as a striping toothpaste dispenser, five of such passages 62*c* are recommended.

Figure 2:
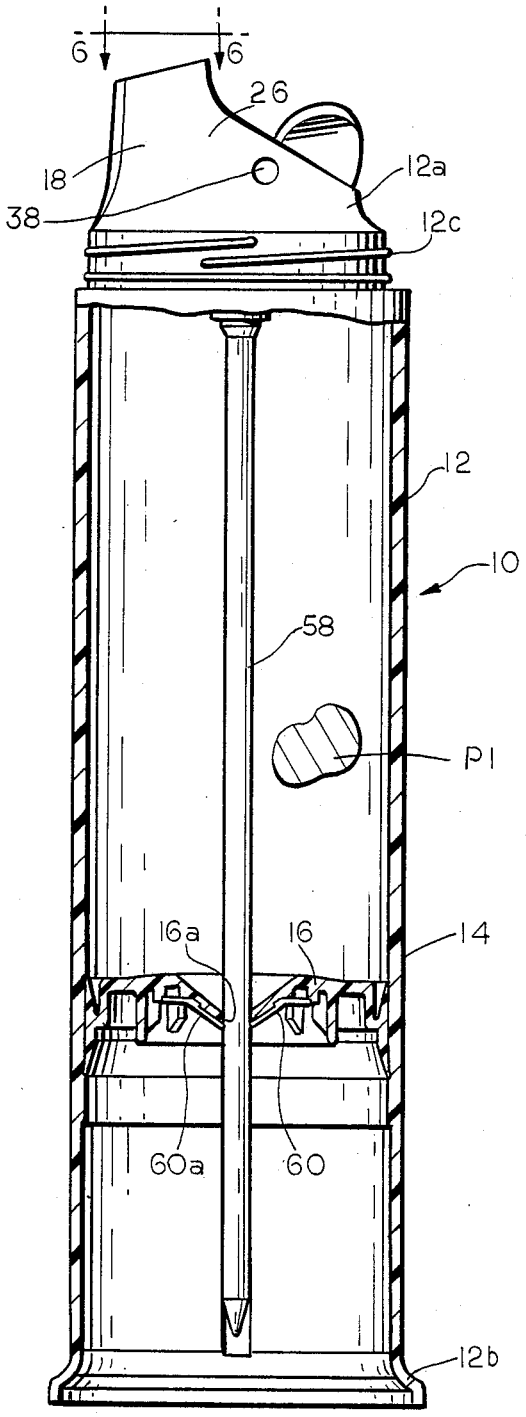
FIG. 2 is an elevational view, at an enlarged scale and partly in section, of the dispensing package of FIG. 1.
Figure 10:
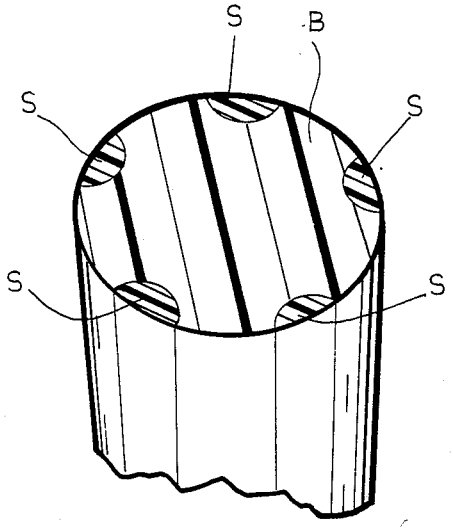
FIG. 10 is a fragmentary perspective view of a composite bead of first and second viscous products that has been dispensed from the striping dispenser package of FIG. 1 through 9.

The annular insert 62 may be manufactured in its illustrated, complex configuration from a suitable thermoplastic material, for example, high density polyethylene or polypropylene, by injection molding. Further, a suitable insert may be manufactured from an aluminum alloy by extrusion. In any case, a second viscous product P2, for example, a product of substantially the same composition as the product P1 but of a contrasting color, is packaged in the annular recess 64 of the container 12, it being important that no portion of the product P2 be packaged below the bottom **62*d* of the annular insert 62. The product P2 is packaged in the container 12, for example, by feeding it into the container 12 while the container 12 is inverted from the position illustrated in FIGS. 1, 2, and 4, and before the feeding of the product P1 into the container 12. Subsequently, while the container 12 is still inverted, the product P2 is fed thereinto, in open communication with the product P1, after which the bottom end 12*b* of the container 12 is closed by inserting the piston 16 thereinto. Thus, when the dispensing pump 36 is actuated, as heretofore explained, the product P1 and the product P2 will be simultaneously pressurized which will result in the extrusion of a composite product having a bead B of the product P1 which is dispensed through the interior of the annular insert 62 and the discharge spout 20, and the simultaneous extrusion of circumferentially spaced apart strips or stripes S of the product P2 from the annular recess 64, into the interior of the annular insert 62 through the passages 62*c*, and then outwardly through the discharge spout 20. To provide indentations in the bead B to receive the stripes S, and to thereby provide for regularity in the external configuration of the composite product being dispensed from the dispensing package 10, as is shown in FIG. 10, the inner portion 62*b* of the annular insert 62 is provided with a plurality of spaced apart inwardly projecting and longitudinally extending indentations which define ribs 62*e*, each of which is aligned with one of the passages 62*c* and terminates near the location of such one of the passages 62*c*. Each such rib 62*e*, thus, forms a longitudinal indentation in the product P1 as it advances upwardly through the inner portion 62*b* of the annular insert 62, and each such indentation receives a strip or stripe of the product P2 which passes into the interior of the annular insert 62 through one of the passages 62*c*. The annular insert 62 further has longitudinally extending recess 62*i* in the exterior thereof, in radial adjustment with the longitudinally extending ribs 62*e* and in axial alignment with the passages 62*c*. The recesses 62*i* permit the product P2 to flow longitudinally as it enters the passages 62*c*** to thereby avoid abrupt changes in its direction of flow.

The interior of the outer portion **20*a* of the spout 20 may be advantageously provided with open gussets 62*h* on opposite sides of the passage 62*c* to help guide the stripes of the product P2 which passes through such passage 62*c* into the aligned indentation in the product P1 which passes through the inner portion 62*b* of the insert 62. The annular insert 62 is accurately positioned and oriented in the spout 20 of the container 12, by providing the interior of the spout 20 is with an inwardly projecting rib 20*c* and the outer portion 62*a* of the annular insert 62 with an outwardly facing recess 62*f* which receives the rib 20*c* in a snap fit, and by providing the exterior of the annular insert with diametrically opposed, outwardly projecting and longitudinally extending ribs 62*g* which are received in longitudinally extending recesses 20*d* of the outer portion 20*a* of the spout 20**.

Figure 3:
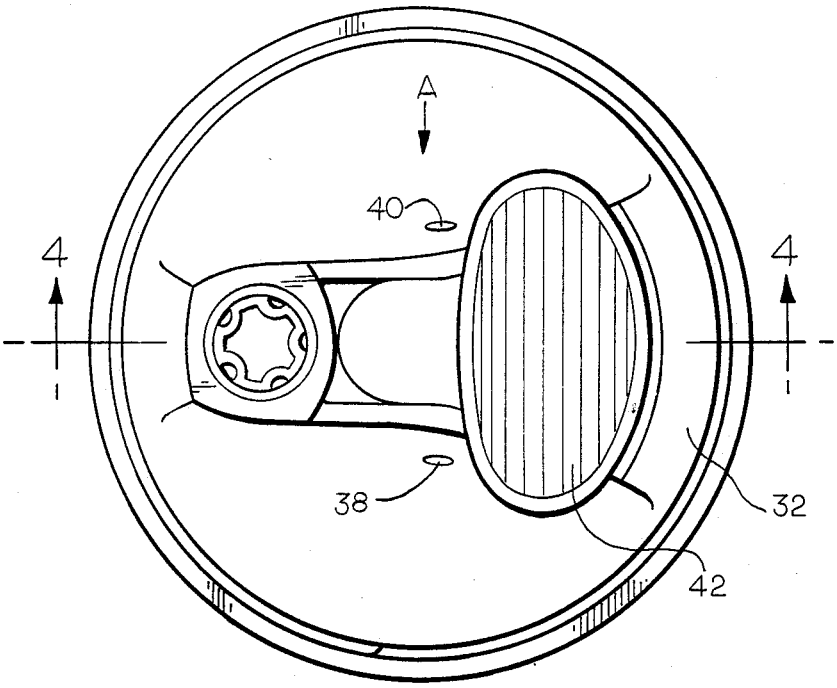
FIG. 3 is a plan view, at a further enlarged scale, of the dispensing package of FIGS. 1 and 2.
Figure 4:
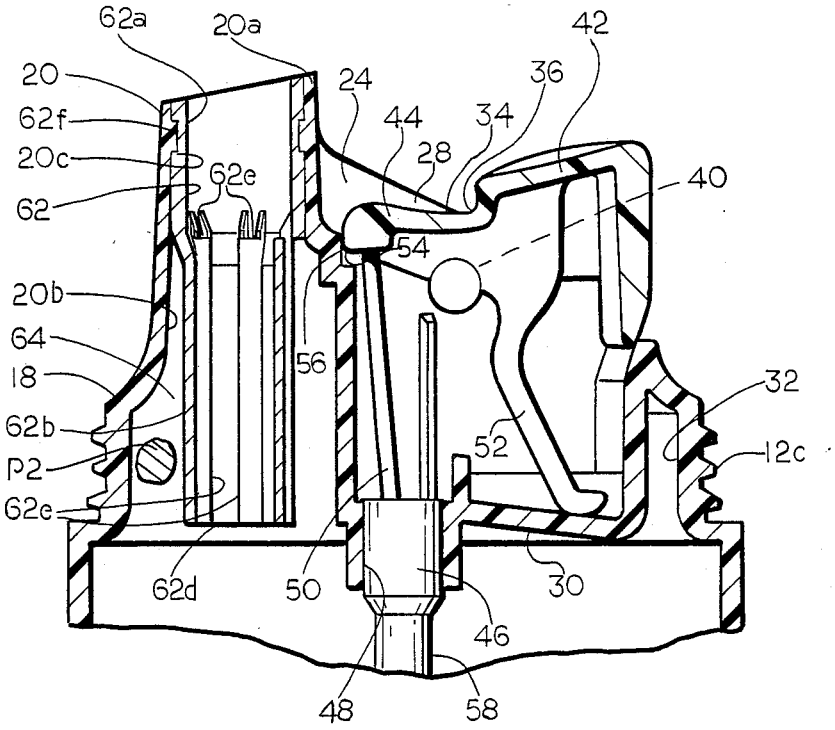
FIG. 4 is a fragmentary sectional view taken on line 4—4 of FIG. 3.
Figure 6:
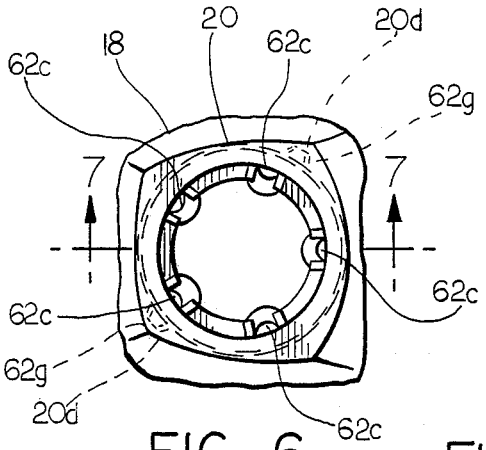
FIG. 6 is a plan view, at an enlarged scale, taken on line 6—6 of FIG. 2.
Figure 5:
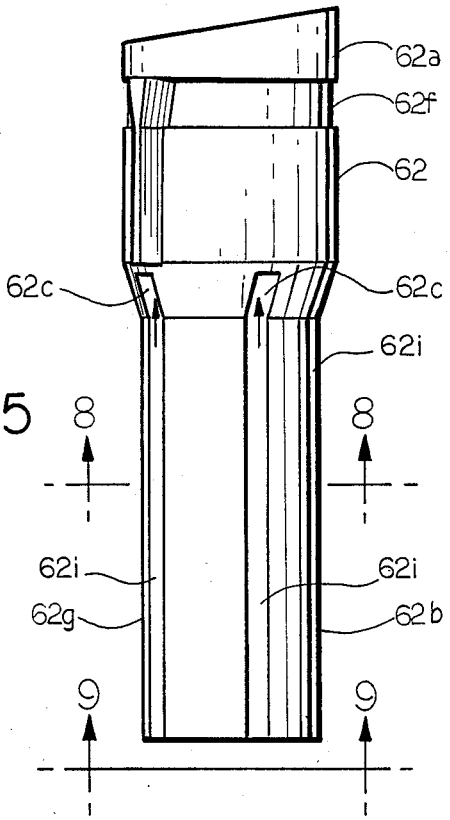
FIG. 5 is an elevational view of an element of the striping dispenser of FIGS. 1 through 4.
Figure 8:
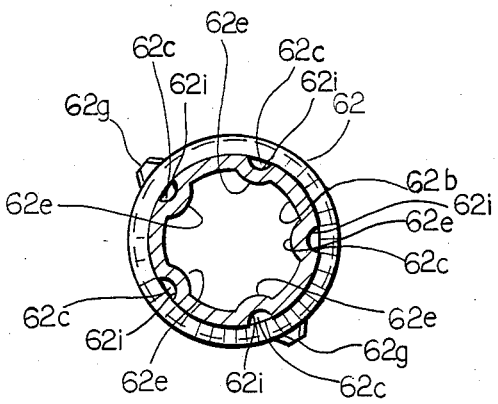
FIG. 8 is a sectional view taken on line 8—8 of FIG. 5.
Figure 7:
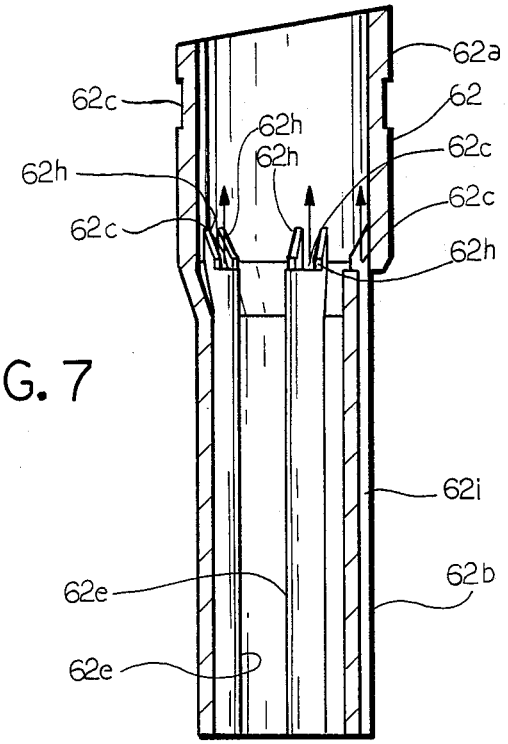
FIG. 7 is a sectional view taken on line 7—7 of FIG. 6, the surrounding structure of the striping dispenser of FIGS. 1 through 4 being omitted.
Figure 9:
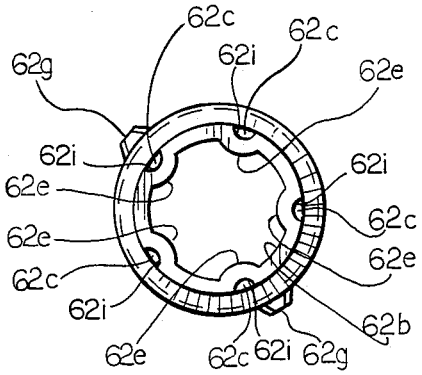
FIG. 9 is an end view taken on line 9—9 of FIG. 5.

While the invention of this application has been described in connection with a dispensing package of the mechanical action type, that is, a package in which the product is pressurized from the bottom by a unidirectionally movable piston that is caused to move by virtue of a mechanical linkage between it and a pumping mechanism at the dispensing end of the package, it is also contemplated that the invention can be practiced in connection with a dispensing package of the vacuum type in which the bottom piston is a floating take-up piston which rises within the container to overcome partial vacuum conditions resulting from the dispensing of product by a separate pumping piston or diaphragm within the container near the dispensing end. FIGS. 3 and 4 of the U.S. Pat. No. 4,691,847 (Ford et al.) illustrate an embodiment of a mechanical action type of dispenser and FIGS. 1 and 2 of the same reference illustrate an embodiment of a vacuum type of dispenser.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A dispensing package for containing and dispensing a composite product comprising a first viscous product and a second viscous product, said composite product having a bead of the first viscous product with the second viscous product being applied to the exterior of the bead in at least one longitudinally extending strip, said dispensing package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer, terminal portion and an inner portion;

an annular insert with an inside surface and an outside surface positioned in said elongate dispensing spout, said annular insert defining an elongate interior passage and having an outer portion positioned snugly within said outer portion of said elongate spout and an inner portion, said inner portion forming a recess with said inner portion of said annular dispensing spout, said recess being adapted to receive the second viscous product, said container further having a portion below said recess which is adapted to receive the first viscous product, said annular insert further having transverse passage means extending through said inner portion of said annular insert to permit the second viscous product from said recess to flow into said elongate passage, said inner portion of said annular insert having a free end which is adapted to be in fluid communication with the first viscous product, said outside surface of said annular insert having indentation means therein defining longitudinally extending recess means therein, said recess means being axially aligned with said transverse passage means and extending from said transverse passage means substantially to said free end; and means for pressurizing the first viscous product and the second viscous product to cause the first viscous product to flow from said portion through said elongate interior passage of said annular insert by way of said free end of said inner portion of said annular insert and to cause the second viscous product to flow from said annular insert through at least a portion of said elongate interior passage of said annular insert by way of said longitudinally extending recess means and said passage means;

wherein said indentation means of said annular insert further defines inwardly projecting and longitudinally extending rib means, said rib means being radially aligned with said longitudinally extending recess means and having a termination at a juncture of said inner portion of said annular insert and said outer portion of said annular insert and being adapted to form at least one recess in the bead of the first viscous product, and wherein said transverse passage means is positioned near and is longitudinally aligned with said termination of said rib means and is adapted to apply the second viscous product in the recess of the bead of the first viscous product.

2. A dispensing package according to claim 1 wherein said recess is annular in configuration, wherein said transverse passage means comprises a plurality of passages circumferentially spaced apart around said annular insert to dispense a composite product having a bead of the first viscous product and a plurality of circumferentially spaced apart and longitudinally extending strips of the second viscous product applied to the exterior of the bead, and wherein said longitudinally extending recess means comprises a plurality of circumferentially spaced apart, longitudinally extending recesses, each of said recesses being in longitudinal alignment with one of said passages.

3. A dispensing package according to claim 2 wherein the passages of said plurality of passages are substantially evenly circumferentially spaced.

4. A dispensing package according to claim 3 wherein said plurality of passages comprises five passages.

5. A dispensing package according to claim 1 wherein said container is formed from a rigid thermoplastic material by injection molding.

6. A dispensing package according to claim 5 wherein said thermoplastic material has a principal ingredient selected from the group consisting of high density polyethylene and polypropylene.

7. A dispensing package according to claim 1 wherein said body portion of said container is generally cylindrical in configuration and has a longitudinal axis, wherein said means for pressurizing comprises pump means at least partly positioned at said dispensing end of said container, said pump means having a rodlike member extending downwardly through said container and parallel to said longitudinal axis and means for reciprocating said rodlike member, a piston initially positioned near said second end of said container, said piston having an aperture receiving and engaging said rodlike member, and means to limit movement between said piston and said rodlike member to movement of said piston within said container along said longitudinal axis toward said dispensing end.

8. A dispensing package according to claim 7 wherein said pump means comprises an elongate portion, said elongate portion being pivotally attached to said wall means extending across said dispensing end of said container for oscillating movement with respect to said dispensing end of said container about an axis positioned between a first end of said elongate portion and a second end of said elongate portion, said rodlike member being attached to said first end of said elongate portion, said second end of said elongate portion having a manually engageable portion to permit said second end to be moved from a first position to a second position, said pump means further comprising resilient means tending to bias said second end of said elongate portion toward said first position.

9. A dispensing package according to claim 5 wherein said outer portion of said annular insert comprises inwardly projecting spaced apart gusset means, said gusset means defining a space which is adjacent to and aligned with said termination of said rib means.

10. A dispensing package according to claim 1 and further comprising means longitudinally and circumferentially orienting said annular insert with respect to said dispensing spout.

11. In combination with a mass of a first viscous product and a mass of a second viscous product, a package containing said first viscous product and said second viscous product for dispensing said first viscous product and said second viscous product in a composite product having a bead of said first viscous product with said second viscous product being applied to the exterior of said bead in at least one longitudinally extending strip, said package comprising:

a container having a body portion with an inside, a first end and a second end, said first end serving as a dispensing end, said container further having wall means extending across said dispensing end of said container, said wall means forming an elongate, annular dispensing spout, said elongate dispensing spout having an outer, terminal portion and an inner portion;

an annular insert with an inside surface an an outside surface positioned in said elongate dispensing spout, said annular insert defining an elongate interior passage and having an outer portion positioned snugly within said outer portion of said elongate spout and an inner portion, said inner portion forming a recess with said inner portion of said dispensing spout, said recess receiving said mass of said second viscous product, said annular insert further having transverse passage means extending through said inner portion of said annular insert to permit said second viscous product from said recess to flow into said elongate passage, said inner product of said annular insert having a free end in fluid communication with said first viscous product, said outside surface of said annular insert having indentation means therein defining longitudinally extending recess means therein, said recess means being aligned with said transverse passage means and extending from said transverse passage means substantially to said free end; and means for pressurizing said first viscous product and said second viscous product to cause said first viscous product to flow from said portion through said elongate interior passage of said annular insert by way of said free end of said inner portion of said annular insert and to cause said second viscous product to flow from said annular insert through at least a portion of said elongate interior passage of said annular insert by way of said longitudinally extending recess means and said passage means;

wherein said indentation means of said annular insert further defines inwardly projecting and longitudinally extending rib means, said rib means being longitudinally aligned with said longitudinally extending recess means and having a termination at a juncture of said inner portion of said annular insert and said outer portion of said annular insert and being adapted to form at least one recess in the bead of said first viscous product, and wherein said transverse passage means is positioned near and is longitudinally aligned with said termination of said rib means and is adapted to apply said second viscous product in the recess of the bead of said first viscous product.

12. A combination according to claim 11 wherein the passages of said plurality of passages are substantially evenly circumferentially spaced.

13. A combination according to claim 12 wherein said plurality of passages comprises five passages.

14. A combination according to claim 5 wherein said body portion of said container is generally cylindrical in configuration and has a longitudinal axis, wherein said means for pressurizing comprises pump means at least partly positioned at said dispensing end of said container, said pump means having a rodlike member extending downwardly through said container and parallel to said longitudinal axis and means for reciprocating said rodlike member, a piston initially positioned near said second end of said container, said piston having an aperture receiving and engaging said rodlike member, and means to limit movement between said piston and said rodlike member to movement of said piston within said container along said longitudinal axis toward said dispensing end.

15. A combination according to claim 14 wherein said pump means comprises an elongate portion, said elongate portion being pivotally attached to said wall means extending across said dispensing end of said container for oscillating movement with respect to said dispensing end of said container about an axis positioned between a first end of said elongate portion and a second end of said elongate portion, said rodlike member being attached to said first end of said elongate portion, said second end of said elongate portion having a manually engageable portion to permit said second end to be moved from a first position to a second position, said pump means further comprising resilient means tending to bias said second end of said elongate portion toward said first position.

16. A combination according to claim 11 wherein said container is formed from a rigid thermoplastic material by injection molding.

17. A combination according to claim 16 wherein said thermoplastic material has a principal ingredient selected from the group consisting of high density polyethylene and polypropylene.

18. A combination according to claim 11 wherein said outer portion of said annular insert comprises internally projecting spaced apart gusset means, said gusset means defining a space which is adjacent to and aligned with said termination of said rib means.

19. A combination according to claim 11 and further comprising means longitudinally and circumferentially orienting said annular insert with respect to said dispensing spout.

* * * * *